US006460728B2

(12) United States Patent
Kamimura

(10) Patent No.: US 6,460,728 B2
(45) Date of Patent: Oct. 8, 2002

(54) AUTOMATIC VENDING MACHINE

(75) Inventor: Ichiro Kamimura, Gunma (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 12 days.

(21) Appl. No.: 09/766,843

(22) Filed: Jan. 23, 2001

(65) Prior Publication Data

US 2001/0022307 A1 Sep. 20, 2001

(51) Int. Cl.[7] ..... A24F 27/14

(52) U.S. Cl. ..... 221/150 HC; 99/357

(58) Field of Search ..... 221/150 R, 150 HC, 221/150 A, 131, 129, 7, 9, 13; 219/678, 679, 601, 399; 99/357, 352

(56) References Cited

U.S. PATENT DOCUMENTS 3,866,795 A * 2/1975 Urano ..... 221/150 HC
5,510,601 A * 4/1996 Smith et al. ..... 221/150 R

* cited by examiner

*Primary Examiner*—Kenneth W. Noland
(74) *Attorney, Agent, or Firm*—Sughrue Mion, PLLC

(57) ABSTRACT

An automatic vending machine is provided in which the exhausted heat produced by cooling is utilized effectively and decrease in running costs is accomplished. The automatic vending machine includes primary heat unit 31 having compressor 52 and primary heat exchanger 53 and secondary heat unit 30B having secondary heat exchanger 43B. The primary heat exchanger 53 is connected with refrigerant-ejecting pipe 32 and refrigerant return pipe 33 attached to the compressor through valves 34A and 34B, respectively, so that changing over is allowed. High-pressure gas pipe 36 connected with the refrigerant-ejecting pipe, low-pressure gas pipe 37 connected with the refrigerant return pipe and liquid pipe 38 connected with the primary heat exchanger are provided. These secondary heat exchangers are connected to the high-pressure gas pipe and the low-pressure gas pipe through valves 39A and 39B selectively operated. The secondary heat units are provided in compartments of the automatic vending machine.

6 Claims, 7 Drawing Sheets

1 automatic vending machine
2 housing
3 front door
4 hear-insulating door
16 supplying inlet
17 article storage
22 article rack
23 side plate
24 partition plate
26 article path
27 article inlet
28 article outlet
29 article carrier
29A holding arm
30B secondary heat unit
31 primary heat unit
41 shoot
42 outlet
43 Bary heat exchanger
44B fan
46B auxiliary electric heater
51 machine chamber
52 compressor
53 primary heat
54 fan
G article 1 automatic vending machine
3 front door
6 article display
7 bill inlet
8 payment display
9 coin inlet
11 coin return
12 return lever
13 lock
14 selecting button
16 supplying inlet
S sample

FIG. 2

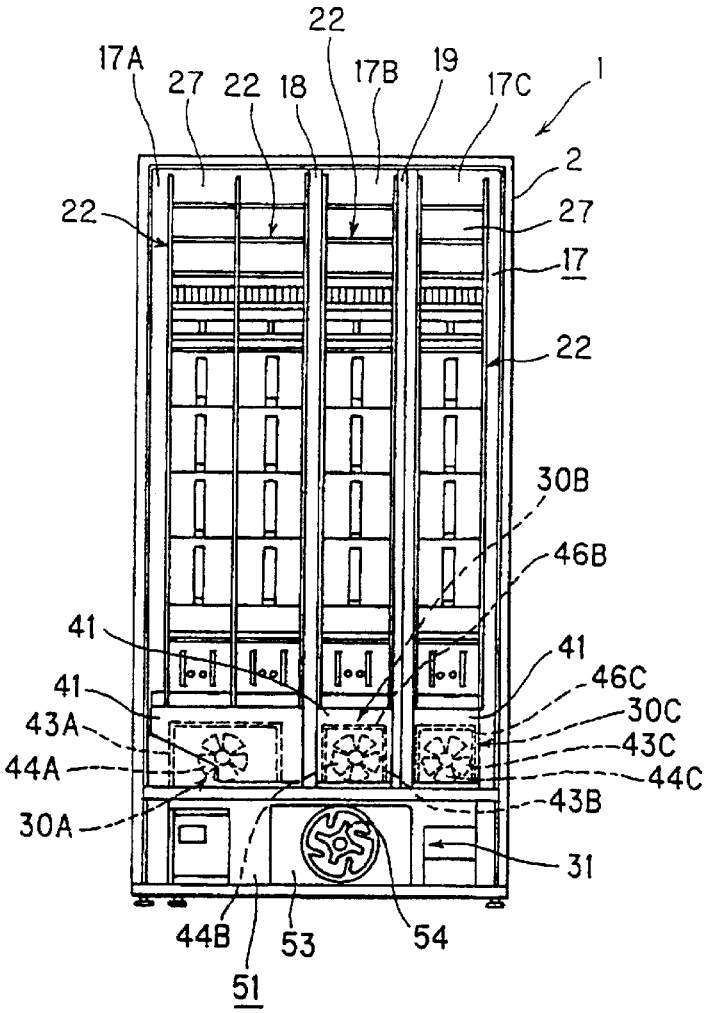

1 automatic vending machine
2 housing
17 article storage
17A specified compartment
17B cooling/heating compartment
17C cooling/heating compartment
18, 19 partition wall
22 article rack
27 article inlet 30A, 30B, 30C secondary heat unit
31 primary heat unit
41 shoot
43A, 43B, 43C secondary heat exchanger
44A, 44B, 44C fan
46A, 46B, 46C auxiliary electric heater
47, 48, 49, coolant flow-controlling valve
51 machine chamber
53 primary heat
54 fan

FIG. 3

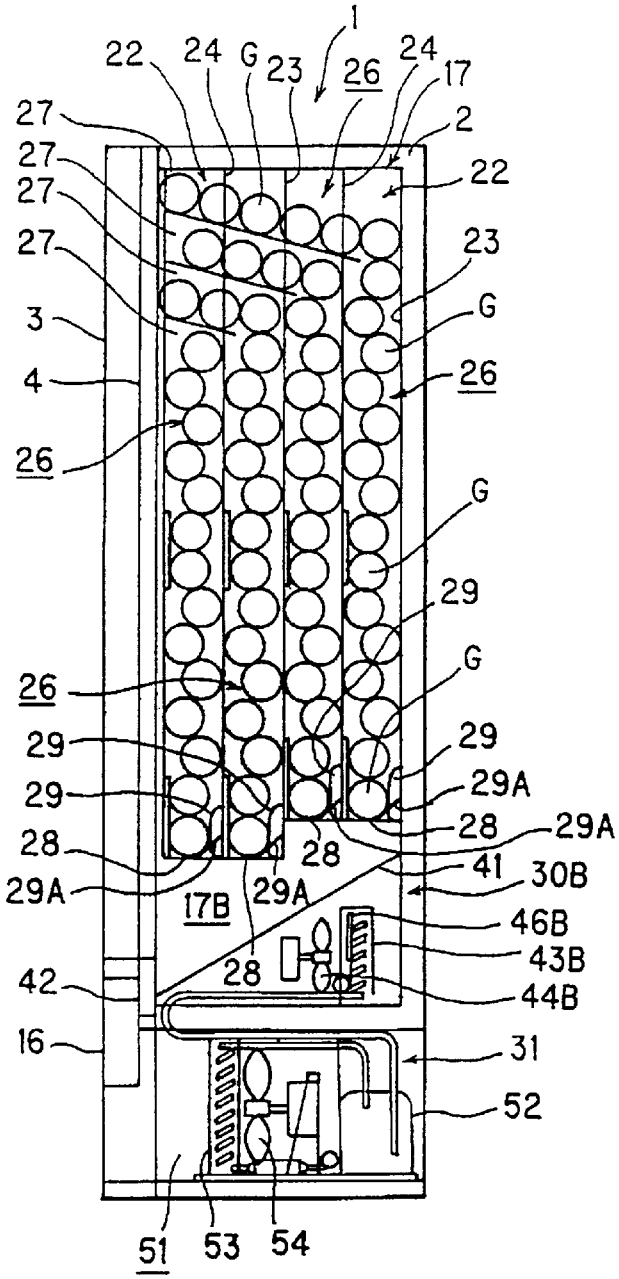

1 automatic vending machine
2 housing
3 front door
4 hear-insulating door
16 supplying inlet
17 article storage
22 article rack
23 side plate
24 partition plate
26 article path
27 article inlet
28 article outlet
29 article carrier
29A holding arm
30B secondary heat unit
31 primary heat unit
41 shoot
42 outlet
43 Bary heat exchanger
44B fan
46B auxiliary electric heater
51 machine chamber
52 compressor
53 primary heat
54 fan
G article 30A, 30B, 30C secondary heat unit
31 primary heat unit
32 refrigerant-ejecting pipe
33 refrigerant return pipe
34A, 34B, valve
35 inter-unit pipe
36 high-pressure gas pipe
37 low-pressure gas pipe 38 liquid pipe
39A, 39B, 40A, 40B valve
43A, 43B, 43C secondary heat exchanger
46B, 46C auxiliary electric heater
47, 48, 49, 50 refrigerant flow-controlling valve
52 compressor
53 primary heat
54 fan
55 gas/liquid separator 34A, 34B valve
39A, 39B, 40A, 40B valve
44A, 44B fan
46B, 46C auxiliary electric heater
47, 48, 49, 50 refrigerant flow-controlling valve
52 compressor
54 fan
56 micro-computer
58A, 58B, 58C temperature sensor 30A, 30B, 30C secondary heat unit
31 primary heat unit
32 refrigerant-ejecting pipe
33 refrigerant return pipe
34A, 34B, valve
35 inter-unit pipe
36 high-pressure gas pipe
37 low-pressure gas pipe
38 liquid pipe
39A, 39B, 40A, 40B valve
43A, 43B, 43C secondary heat exchanger
46B, 46C auxiliary electric heater
47, 48, 49, 50 refrigerant flow-controlling valve
52 compressor
53 primary heat
54 fan
55 gas/liquid separator 30A, 30B, 30C secondary heat unit
31 primary heat unit
32 refrigerant-ejecting pipe
33 refrigerant return pipe
34A, 34B, valve
35 inter-unit pipe
36 high-pressure gas pipe
37 low-pressure gas pipe 38 liquid pipe
39A, 39B, 40A, 40B valve
43A, 43B, 43C secondary heat exchanger
46B, 46C auxiliary electric heater
47, 48, 49, 50 refrigerant flow-controlling valve
52 compressor
53 primary heat
54 fan
55 gas/liquid separator

AUTOMATIC VENDING MACHINE

FIELD OF THE INVENTION

The invention relates to an automatic vending machine for cooling or heating and vending articles such as canned beverages.

BACKGROUND OF THE INVENTION

A conventional vending machine is composed of a storage case for storing articles to be sold provided in a housing formed of a thermally insulated box. The storage case is divided into a plurality of compartments. The compartments for storing cold articles at a temperature such as about 5° C. are each cooled according to a known cooling cycle and the compartments for storing hot articles at a temperature, for example, about 60° C. are heated by electric heaters.

Heretofore, an electric heater is used as a heating means. A great amount of heat is required to obtain the amount of heat enough for the heating. The heat in the heated compartments provided with electric heaters leaks to the compartments for cooling because these cooling compartments and heating compartments are present together. Thus, a greater amount of heat has to be expelled to the outside to the extent of such leak and, therefore, the cooling cycle has to be operated at higher rate, causing a problem of increased running costs.

SUMMARY OF THE INVENTION

This invention has made to solve such a technical problem in the prior art.

It is an object of the invention to provide an automatic vending machine accomplishing decrease of the running costs by utilizing effectively the exhausted heat produced by cooling.

According to invention, an automatic vending machine provided with a storage case for articles to be sold provided in a housing formed of a heat-insulating box, the storage case is divided into a plurality of compartments in which the articles contained therein are cooled or heated to be sold through one or more outlets, comprises:

- a primary heat unit provided with a compressor and a primary heat exchanger connected with a refrigerant-ejecting pipe and a refrigerant return pipe through a selective valve;
- a refrigerant flow-controlling valve for controlling amount of refrigerant flowing into the primary heat unit;
- a control apparatus for controlling the refrigerant flow-controlling valve;
- a plurality of secondary heat units each having a secondary heat exchanger and being located in each of the compartments; and
- a plurality of conduit pipes connecting the primary heat unit with the plurality of secondary heat units, each comprising a high-pressure gas pipe connected with the refrigerant ejecting pipe, a low-pressure gas pipe connected with the refrigerant return pipe, and a liquid pipe connected with the primary heat exchanger:
- each of the secondary heat exchangers being connected selectively with the high-pressure gas pipe and the low-pressure gas pipe through a selecting valve;
- the liquid pipe being provided with a heating/cooling apparatus connected with a refrigerant flow-controlling valve.

The automatic vending machine according to the invention, so constituted as to have a simply constructed circuit using a uni-functional primary heat exchange unit, can be operated to cool or heat all the compartments simultaneously by a plurality of secondary heat exchangers as well as to cool and heat the compartments selectively by selected secondary heat exchangers at the same time.

Efficient operation by heat recycling is allowed in the case of cooling and heating operation in parallel because the secondary heat exchangers serving then as condensers are connected in series with the primary heat exchanger serving then as an evaporator, thereby facilitating a remarkable decrease in the running costs.

An automatic vending machine according to the second feature of the invention further comprises:

- a specified secondary heat unit provided in the cooled or heated compartment, having a secondary heat exchanger connected between a liquid pipe and a low-pressure gas pipe or a high-pressure gas pipe;
- the secondary heat exchanger in the specified secondary heat unit having a volume equal to sum of volumes of the secondary heat exchangers in other secondary heat units.

In the automatic vending machine, according to the second feature of the invention, in which the secondary heat exchanger in the specified secondary heat unit is used for cooling, serving as an evaporator, and the secondary heat exchangers in the other secondary heat units are used for heating, serving as condensers, for example, heating by exhausted heat and cooling by heat absorption by these secondary heat exchangers can be balanced without using the primary heat exchanger. Thus, more efficient operation is accomplished because of more effective recovery of heat.

BRIEF DESCRIPTION OF THE DRAWINGS

The invention will be explained in more detail in conjunction with the appended drawings, wherein:

FIG. 2 is a front view of the automatic vending machine excluding front door and heat-insulating door in the preferred embodiment;

FIG. 3 is a cross-sectional view along a vertical plane of the automatic vending machine in the preferred embodiment;

DESCRIPTION OF THE PREFERRED EMBODIMENTS

An automatic vending machine in the first preferred embodiment of the invention will be explained below.

Figure 1:
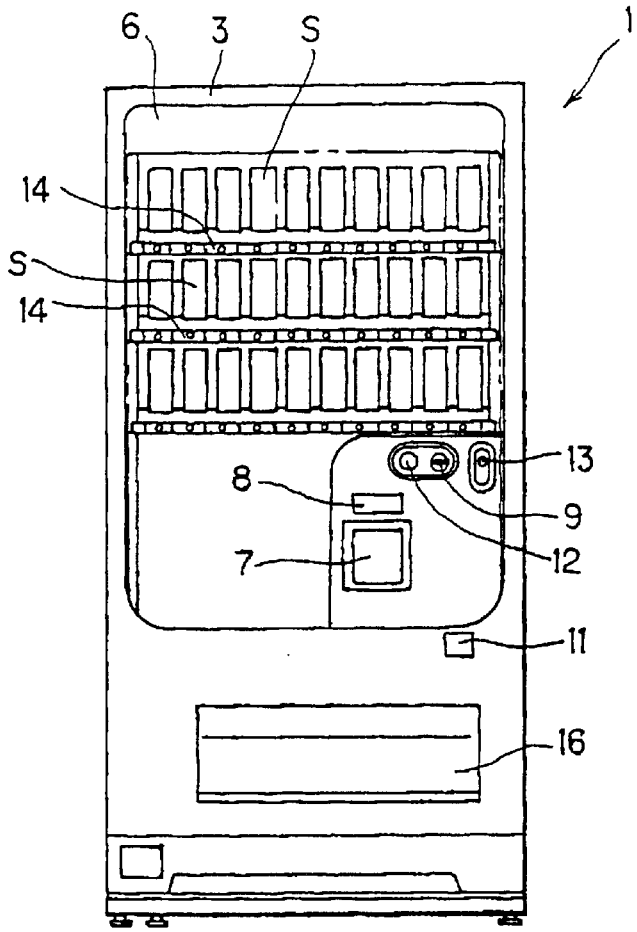
FIG. 1 is a front view showing a preferred embodiment of an automatic vending machine according to the invention.

FIG. 1 is a front view showing a preferred embodiment of an automatic vending machine according to the invention. FIG. 2 is a front view of the automatic vending machine 1 excluding front door 3 and heat-insulating door 4. FIG. 3 is a cross-sectional view along a vertical plane.

Automatic vending machine 1 in the preferred embodiment serves to supply canned beverages cooled to a temperature such as 5° C. or heated to a temperature such as about 60° C. Automatic vending machine 1 is composed of housing 2 formed of an heat-insulated box with an opening in front thereof and front door 3 which is pivotted rotatably around one edge to housing 2 and can be opened or closed at liberty. Front door 3 is provided with article display 6 in which a plurality of samples such as S are displayed. In the right lower corner, bill inlet 7, payment display 8, coin inlet 9, coin return 11, return lever 12 and lock 13. Selecting buttons 14 are provided in front of article display 6 below article samples each of which corresponds to each of the selecting buttons. Supplying outlet 16 is provided in the lower part of front door 3.

Behind front door 3, article storage 17 having heat-insulating door 4 in front thereof is provided within housing 2. As shown in FIG. 2, article storage 17 is divided into three compartments by partition walls 18 and 19 filled with heat insulating material inside. Specified compartment 17A is formed to the left of partition wall 18. Cooling/heating compartment 17B which can be changed over to cooling or heating selectively is formed between partition walls 18 and 19, in the middle of article storage 17. Further, cooling/heating compartment 17C is formed to the right of partition wall 19.

Two rows of article racks, in front and behind, are suspended in article storage 17. Two series of article racks 22 are arranged laterally in specified compartment 17A having the greatest volume. A single line of article racks 22 is contained respectively in cooling/heating compartments 17B and 17C each having volume a half that of specified compartment 17A. Two rows of article paths 26, 26 extending vertically, being arranged in front and behind, are formed in each of article racks 22 by side plate 23 forming the outer shell and partition plates 24 dividing the inside into front and rear parts. Article inlet 27 is formed opening at the top of each article path 26. At the bottom of article path 26, article outlet 28 is formed open and provided with article carrier 29 fixed on side plate 23 or partition plate 24.

Article carrier 29, called ejector mechanism (or vending mechanism), has holding arm 29A normally projecting toward article path 26, holding article G at the bottom of corresponding article path 26. For vending an article, holding arm 29A mentioned above is driven to be slanted along side plate 23 or partition plate 24 by means of an actuator such as solenoid, not shown, so that article G falls down on article path 26 one by one.

Below article rack 22 so constructed, there is provided shoot 41 slanted forward slightly onto which article G ejected from each article rack 22 falls down and then rolls down to move through outlet 42 in heat-insulating door 4 to enter into outlet 16 in front door 3 mentioned above. Secondary heat unit 30A to be mentioned in more detail (specified secondary heat unit), secondary heat unit 30B and secondary heat unit 30C are provided below each shoot 41, corresponding to specified compartment 17A and cooling/heating compartments 17B and 17C. Each unit has fans 44A, 44B and 44C respectively. Cooling/heating compartments 17B and 17C are provided with auxiliary electric heaters 46B and 46C.

Meanwhile, machine chamber 51 is provided under housing 2, Machine chamber 51 is furnished with primary heat unit 31 and fan 54. Cooling and heating means of automatic vending machine 1 are composed of primary heat unit 31 and secondary heat units 30A, 30B and 30C.

Figure 4:
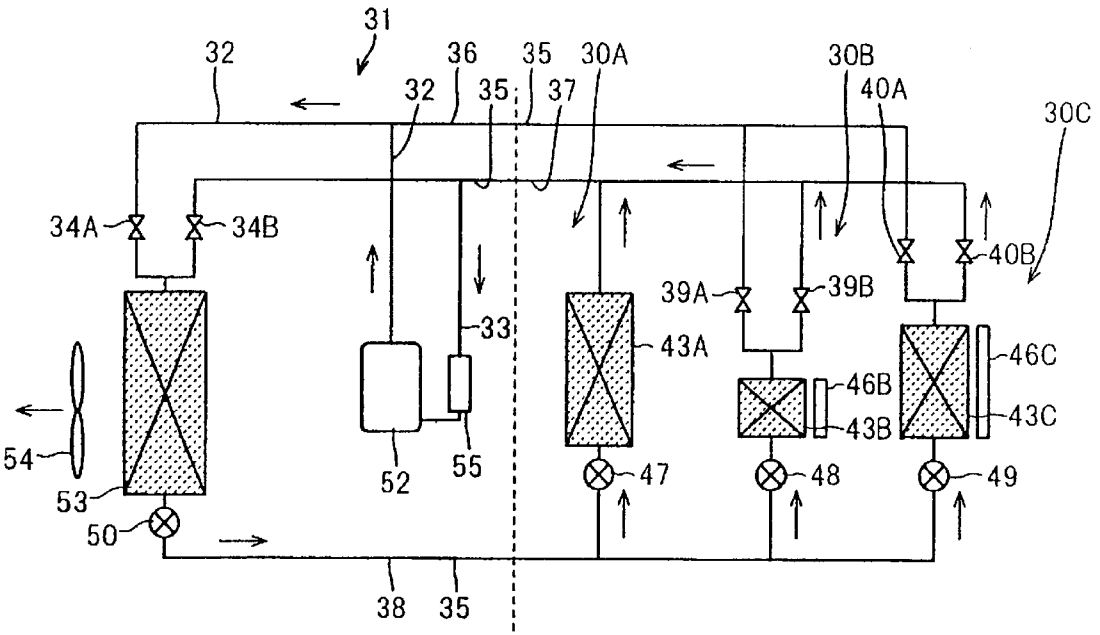
FIG. 4 is a circuit diagram of a refrigerant circuit in the automatic vending machine in the preferred embodiment.

The refrigerant circuit in automatic vending machine 1 in the preferred embodiment will be explained with reference to FIG. 4. Primary heat unit 31 mentioned above consists of compressor 52, primary heat exchanger 53 and gas/liquid separator 55. Secondary heat units 30A, 30B and 30C include secondary heat exchangers 43A, 43B and 43c, respectively. Primary heat exchanger 53 is connected with refrigerant-ejecting pipe 32 and refrigerant return pipe 33 through valves 34A and 34B, respectively. Inter-unit pipe 35 connecting primary heat unit 31 with secondary heat units 30A, 30B and 30C consists of high-pressure gas pipe 36 connected selectively with refrigerant-ejecting pipe 32, low-pressure gas pipe 37 connected selectively with refrigerant return pipe 33, and of liquid pipe 38.

Secondary heat exchanger 43A in secondary heat unit 30A is connected with low-pressure gas pipe 37, and also with liquid pipe 38 through refrigerant flow-controlling valve 47 such as motorized expansion valve. Secondary heat exchangers 43B and 43C in secondary heat units 30B and 30C, respectively, are connected selectively with high-pressure gas pipe 36 and low-pressure gas pipe 37 through valves 39A, 39B, 40A and 40B, respectively, and with liquid pipe 38 through refrigerant flow-controlling valves 48 and 49 such as motorized expansion valves.

There is also refrigerant flow-controlling valve 50 such as motorized expansion valve interrupting liquid pipe 38. In this embodiment in which specified compartment 17A serves only for cooling, primary heat unit 30A lacks valves such as 39A, 39B, 40A and 40B present in secondary heat units 30B and 30C. Selecting valves consisting of these combination of ON and OFF valves may be connected selectively with refrigerant-ejecting pipe 32 and refrigerant return pipe 33 so as to make cooling also possible. Further, specified compartment 17A may be used only for heating, wherein secondary heat exchanger 43A should be connected with high-pressure gas pipe 36.

The volumes of heat exchangers in the preferred embodiment are so selected that, assuming the volume of secondary heat exchanger 43B to be 1, the volume of secondary heat exchanger 43C is to be 2. the volume of secondary heat exchanger 43A is to be 3, and the volume of primary heat exchanger 53 is to be 6.

Figure 5:
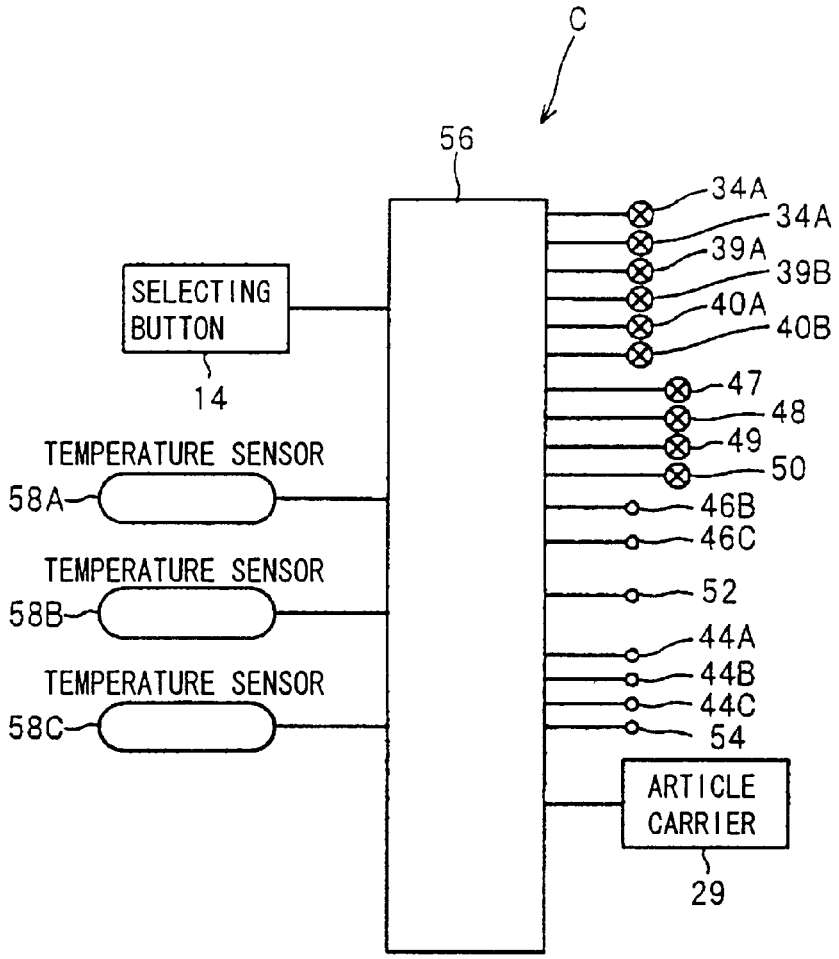
FIG. 5 is a explanatory view showing the construction of control unit in the automatic vending machine in the preferred embodiment.

FIG. 5 shows the construction of control unit C in automatic vending machine 1. Control unit C consists of micro-computer 56 for common use, to input terminal of which there are connected selecting buttons 14 (only one is shown) for selecting articles G mentioned above and temperature sensors 58A, 58B and 58C disposed in aforesaid specified compartment 17A, cooling/heating compartment 17B and cooling/heating compartment 17C, respectively, as temperature detecting means. The output terminal of micro-computer 56 is connected with valves 34A, 34B, 39A, 39B, 40 A and 40B, refrigerant flow-controlling valves 47, 48 and 49, refrigerant flow-controlling valve 50, auxiliary electric heaters 46A and 468, compressor 52, fans 44A, 44B, 44C and 54 and article carriers 29 (only one is shown).

The automatic vending machine having aforesaid constitution will be explained in the following. The first case in which either of specified compartment 17A and cooling/heating compartments 17B and 17C is used for cooling articles will be explained with reference to FIG. 4. If any of the temperatures detected by temperature sensors 58A, 58B and 58C reaches or exceeds the temperature set for cooling, for example, about 0° C., micro-computer 56 operates to open valve 34A attached to refrigerant-ejecting pipe 32 and to close valve 34B attached to refrigerant return pipe 33, in primary heat exchanger 53, to close valves 39A and 40A attached to high-pressure gas pipe 36 and to open valves 39B and 40B attached to low-pressure gas pipe 37, in secondary heat exchangers 43B and 43C.

Thus, the refrigerant (cooling medium) ejected from compressor 52 flows through refrigerant-ejecting pipe 32 and valve 34A to primary heat exchanger 53, where the refrigerant is condensed to be a liquid, and then flows through refrigerant flow-controlling valve 50 and liquid pipe 38 and is distributed to refrigerant flow-controlling valves 47, 48 and 49 in secondary heat units 30A, 30B and 30C, respectively.

At this moment, micro-computer 56 operates to open refrigerant flow-controlling valve 50 completely and refrigerant flow-controlling valves 47, 48 and 49 are regulated to restrain the flow based on the outputs of temperature sensors 58A, 58B and 58C, respectively. Then, the refrigerant passing refrigerant flow-controlling valves 47, 48 and 49 flows into secondary heat exchangers 43A, 43B and 43C, respectively to be evaporated. Then, the refrigerant from secondary heat exchangers 43B and 43C enters into low-pressure gas pipe 37 by way of valves 39B and 39C. The refrigerant from secondary heat exchangers 43A enters directly into low-pressure gas pipe 37. Then, the refrigerant collected in low-pressure gas pipe 37 passes refrigerant return pipe 33 and then gas/liquid separator 55 and is taken into compressor 52.

In the first case, as explained above, primary heat exchanger 53 functions as a condenser, and secondary heat exchangers 43A, 43B and 43C function as evaporators, thus, specified compartment 17A and cooling/heating compartments 17B and 17C are cooled to a suitable temperature for cold drinks, such as about 0° C., simultaneously. Articles stored in these compartments are cooled to about 5° C. or lower. Because the volume of primary heat exchanger 53 is about equal to the sum of volumes of secondary heat exchangers 43A, 43B and 43C, the heat exhausted from secondary heat exchangers 43A, 43B and 43C which function as evaporators is radiated sufficiently by primary heat exchanger 53.

Figure 6:
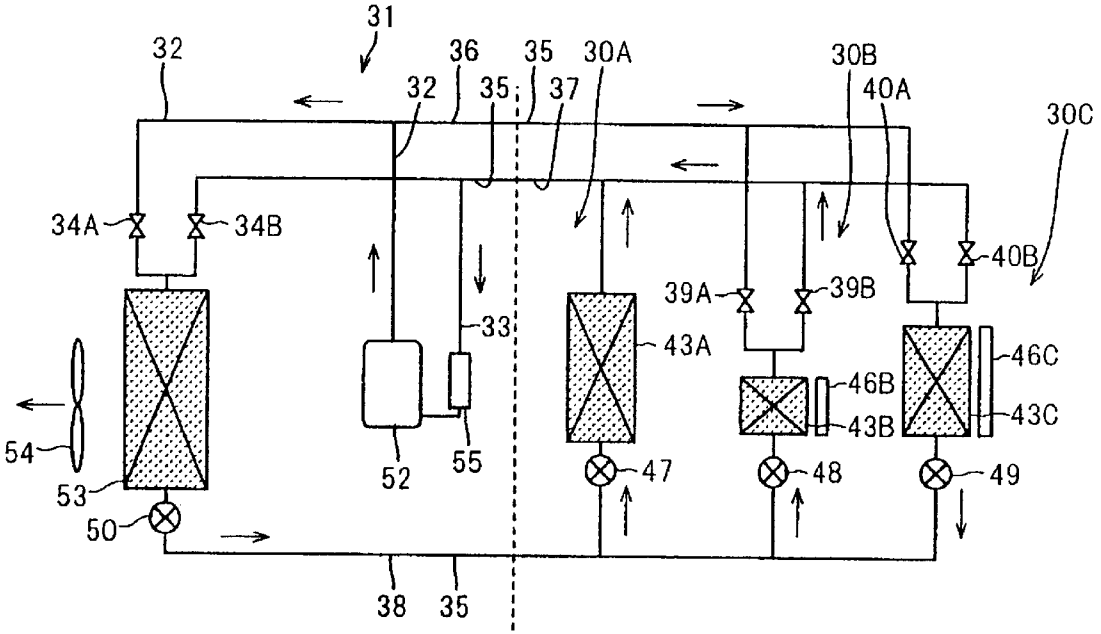
FIG. 6 is a circuit diagram of another refrigerant circuit in the automatic vending machine in the preferred embodiment.

The second case in which specified compartment 17A and cooling/heating compartment 17B are used for cooling articles while cooling/heating compartment 17C is heated will be explained with reference to FIG. 6. If any of the temperatures detected by temperature sensors 58A and 58B reaches or exceeds the temperature set for cooling, micro-computer 56 operates to open valve 34A and close valve 34B, in primary heat exchanger 53, to close valve 39A and open valve 39B, in secondary heat exchanger 43B, and to open valve 40A and close valve 40B, in secondary heat exchanger 43C.

Accordingly, a part of the refrigerant ejected from compressor 52 passes refrigerant-ejecting pipe 32 and then valve 34A to flow into primary heat exchanger 53, while remaining refrigerant passes high-pressure gas pipe 36 to flow into secondary heat exchanger 43C by way of valve 40A in secondary heat unit 30C. The refrigerant is condensed into liquid by secondary heat exchanger 43C and primary heat exchanger 53. The refrigerant condensed in heat exchangers 43C and 53 passes liquid pipe 38 and decompressed by refrigerant flow-controlling valves 47 and 48 in secondary heat units 30A and 30B, respectively, and then flows into secondary heat exchangers 43A and 43B, respectively, to be evaporated.

Micro-computer 56 operates to open refrigerant flow-controlling valves 49 and 50 completely. Refrigerant flow-controlling valves 47 and 48 are regulated to restrain the flow based on the outputs of temperature sensors 58A and 58B respectively. If the temperature of cooling compartment 17C does not exceed the temperature set for heating according to the output of temperature sensor 58C, auxiliary electric heater 46C is powered to heat cooling compartment 17C additionally.

The refrigerant passing secondary heat exchanger 43A flows into low-pressure gas pipe 37 and the refrigerant passing secondary heat exchanger 43B flows through valve 39B into low-pressure gas pipe 37, where the two portions of refrigerant join, pass refrigerant return pipe 33 and gas/liquid separator 55 to be taken into compressor 52. Secondary heat exchanger 43A hereby functions as a condenser, as mentioned above, cooling/heating compartment 17C is heated, while specified compartment 17A and cooling/heating compartment 17B are cooled by secondary heat exchanger 43A and 43B, respectively, which function as evaporators.

In such case of operation of cooling and heating in parallel, refrigerant flow-controlling valve 49 in secondary heat exchanger 30C is opened completely so that the pressure loss of refrigerant is prevented. The pressure of liquid refrigerant in liquid pipe 38 is regulated by refrigerant flow-controlling valve 50 by the help of micro-computer 56 so as to prevent the pressure imbalance.

The exhausted heat produced on cooling of secondary heat units 30A and 30B can be used in secondary heat unit 30C to heat cooling/heating compartment 17C, as described above. Thus, heat can be recovered and utilized effectively to facilitate efficient operation of the machine. Consequently, power consumption, thus the running costs, can be reduced compared to conventional automatic vending machines in which only electric heaters are used for heating.

If secondary heat unit 30C is not enough to attain the temperature set for heating, particularly in cold season or in cold regions, micro-computer 56 operates to supply power to auxiliary electric heater 46C for additional heating, as mentioned above, power consumption in the electric heaters even in this occasion is remarkably reduced compared to prior art.

Figure 7:
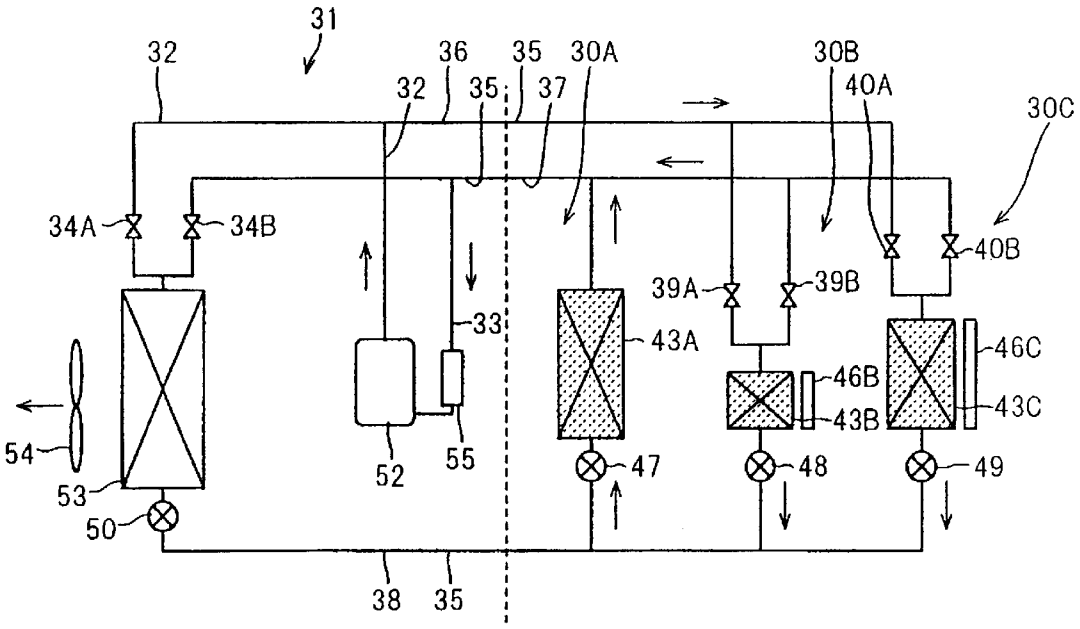
FIG. 7 is a circuit diagram of still another refrigerant circuit in the automatic vending machine in the preferred embodiment.

Another case in which specified compartment 17A is cooled while cooling/heating compartments 17B and 17C are heated will be explained with reference to FIG. 7. If temperature detected by temperature sensor 58A reaches or exceeds the temperature set for cooling, micro-computer 56 mentioned above operates to close valves 34A and 34B in primary heat exchanger 53, to open valve 39A and close valve 393 in secondary heat exchanger 43B, and to open valve 40A and close valve 40B, in secondary heat exchanger 43C.

Thus, the refrigerant ejected from compressor 52 passes refrigerant ejecting pipe 32 and high-pressure gas pipe 36 and flows through valves 39A and 40A into secondary heat exchangers 43B and 43C, respectively, in secondary heat units 30B and 30C, respectively, where these portions of refrigerant are condensed. The refrigerants condensed in secondary heat exchangers 43B and 43C pass liquid pipe 38 and are decompressed by refrigerant flow-controlling valve 47 and evaporated in secondary heat exchanger 43A in secondary heating unit 30A.

Micro-computer 56 operates to open refrigerant flow-controlling valves 48, 49 and 50 completely. Refrigerant flow-controlling valve 47 is regulated to restrain the flow based on the outputs of temperature sensors 58A and 58B, respectively. If the temperature of cooling compartment 17C is not higher than the temperature set for heating, for example, about 65 to 48° C., according to the output of temperature sensors 58B and 58C, auxiliary electric heaters 46B and 46C are powered to heat cooling compartment 17C additionally.

The refrigerant passing secondary heat exchanger 43A flows into low-pressure gas pipe 37 and passes refrigerant return pipe 33 and then gas/liquid separator 55 to be taken into compressor 52. Cooling/heating compartments 17B and 17C are heated by secondary heat exchangers 43B and 43C, respectively, which hereby function as condensers, as mentioned above, while specified compartment 17A is cooled by secondary heat exchanger 43A which functions as an evaporator As described above, secondary heat units 30B and 30C are heated by the exhausted heat produced on cooling of secondary heat unit 30A, thus heat can be recovered and utilized effectively to facilitate efficient operation of the machine.

The volumes of secondary heat exchangers 43A, 43B and 43C in this embodiment are, as described above, so designed that the volume of secondary heat exchanger 43A (relatively 3) is equal to the sum of volumes of secondary heat exchanger 43B (relatively 1) plus the volume of secondary heat exchanger 43C (relatively 2). Therefore, secondary heat exchangers 43B and 43C can be heated by the exhausted heat produced by secondary heat exchanger 43A functioning as an evaporator, whereby removal of the exhausted heat using primary heat exchanger 53 is not required, facilitating thus efficient operation due to effective heat recovery.

Consequently, power consumption, thus the running costs, can be reduced compared to conventional automatic vending machines in which only electric heaters are used for heating.

Cooling media which may be used in the refrigerant circuit in the automatic vending machine described above are, for example, Flon (substitute Flon) such as HFC and hydrocarbons such as propane, butane, and pentane. Substitute Flon calls attention as cooling media having no hazard on the ozone layer but possibly accelerate warming of the earth when diffused into the atmosphere. Thus, it may harm the effect of utilization of waste heat. Hydrocarbons do not cause ozone layer deterioration and globe warming but care must be taken to separate them from a heat source such as heater so as to cause no accident by fire.

As described in detail above, the automatic vending machine according to the invention, so constituted as to have a simply constructed circuit using a uni-functional primary heat exchange unit, can be operated not only to cool or heat all the compartments simultaneously by a plurality of secondary heat exchangers, but also to cool some of the compartments and heat other compartments, at the same time, by selecting secondary heat exchangers arbitrarily.

Further, in the case of cooling and heating of compartments simultaneously, wherein a secondary heat exchanger serving as a condenser and a primary heat exchanger serving as an evaporator are connected in series, thus efficient operation by heat recovery is accomplished, allowing remarkable reduction in running costs.

The automatic vending machine according to the second feature of the invention, in which a certain secondary heat exchanger, for example, that in a specified secondary heat unit, is used for cooling, serving as an evaporator, while another secondary heat exchanger in another secondary heat unit is used for heating, serving as a condenser, makes it possible to balance heating by the exhausted heat and cooling by the absorbed heat in respective secondary heat exchangers, without using the primary heat exchanger. Accordingly, efficient operation by more effective heat recovery is accomplished.

Although the invention has been described with respect to specific embodiments for complete and clear disclosure, the appended claims are not to be thus limited but are to be construed as embodying all modifications and alternative constructions that may occur to one skilled in the art which fairly fall within the basic teaching set forth herein.

What is claimed is:

1. An automatic vending machine provided with a storage case for articles to be sold in a housing formed of a heat-insulating box, said storage case being divided into a plurality of compartments in which articles contained therein are cooled or heated to be sold through one or more outlets, comprising:

a primary heat unit provided with a compressor and a primary heat exchanger connected with a refrigerant-ejecting pipe and a refrigerant return pipe through a selecting valve;

a refrigerant flow-controlling valve for controlling amount of refrigerant flowing into said primary heat unit;

a control apparatus for controlling said refrigerant flow-controlling valve;

a plurality of secondary heat units each having a secondary heat exchanger and being located in each of said compartments; and a plurality of conduit pipes connecting the primary heat unit with said plurality of secondary heat units, each comprising a high-pressure gas pipe connected with said refrigerant-ejecting pipe, a low-pressure gas pipe connected with said refrigerant return pipe, and a liquid pipe connected with said primary heat exchanger;

each of said secondary heat exchangers being connected selectively with said high-pressure gas pipe and said low-pressure gas pipe through a selecting valve;

said liquid pipe being provided with a heating/cooling apparatus connected with a refrigerant flow-controlling valve.

2. The vending machine, as defined in claim 1, wherein:

said refrigerant flowing pipes comprise a high pressure gas pipe, a low pressure gas pipe and a liquid pipe; and each of said plurality of heat exchangers to be used as a heater and a cooler is connected via gas flow-controlling valves to said high and low pressure gas pipes, and via a flow-amount-controlling valve to said liquid pipe.

3. The vending machine, as defined in claim 2, wherein:

said main heat exchanger is connected via ON and OFF valves to said high and low pressure gas pipes, and via a low amount-controlling valve to said liquid pipe.

4. An automatic vending machine provided with a storage case for articles to be sold in a housing formed of a heat-insulating box, said storage case being divided into a plurality of compartments in which said articles contained therein are cooled or heated to be sold through one or more outlets, comprising:

a primary heat unit provided with a compressor and a primary heat exchanger connected with a refrigerant-ejecting pipe and a refrigerant return pipe through a selecting valve;

a refrigerant flow-controlling valve for controlling amount of refrigerant flowing into said primary heat unit;

a control unit for controlling said refrigerant flow-controlling valve;

a plurality of secondary heat units each having a secondary heat exchanger and being located in each of said compartments;

a plurality of conduit pipes connecting the primary heat unit with said plurality of secondary heat units, each comprising a high-pressure gas pipe connected with said refrigerant-ejecting pipe, a low-pressure gas pipe connected with said refrigerant return pipe, and a liquid pipe connected with said primary heat exchanger; and a specified secondary heat unit provided in said cooled or heated compartment, having a secondary heat exchanger connected between a liquid pipe and a low-pressure gas pipe or a high-pressure gas pipe;

each of said secondary heat exchangers being connected selectively with said high-pressure gas pipe and said low-pressure gas pipe through a selecting valve;

said liquid pipe being provided with a heating/cooling apparatus connected with a refrigerant flow controlling valve;

said secondary heat exchanger in said specified secondary heat unit having a volume equal to sum of volumes of said secondary heat exchangers in other secondary heat units.

5. A vending machine comprising:

a plurality of article-housing units each thermally insulated from each other;

a plurality of heat exchangers provided in said plurality of article-housing units;

a main heat exchanger provided outside said plurality of article-housing units, said main heat exchanger being connected to said plurality of heat exchangers by refrigerant flowing pipes; and a control unit for controlling operation of said main heat exchanger and said plurality of heat exchangers;

wherein said plurality of heat exchangers are selectively controlled to operate as a heater or a cooler by said control unit.

6. In an automatic vending machine comprising a storage case for storing articles to be sold, a housing formed of a heat-insulating box and one or more outlets attached to said storage case;

said storage case being provided in said housing and divided into a plurality of compartments in which articles contained therein are cooled or heated to be sold through said outlets;

the improvement wherein the automatic vending machine comprises:

a primary heat unit provided with a compressor and a primary heat exchanger connected with a refrigerant-ejecting pipe and a refrigerant return pipe through a selecting valve;

a refrigerant flow-controlling valve for controlling amount of refrigerant flowing into said primary heat unit;

a control unit for controlling said refrigerant flow-controlling valve;

a plurality of secondary heat units each having a secondary heat exchanger and being located in each of said compartments; and a plurality of conduit pipes connecting said primary heat unit with said plurality of secondary heat units, each comprising a high-pressure gas pipe connected with said refrigerant-ejecting pipe, a low-pressure gas pipe connected with said refrigerant return pipe, and a liquid pipe connected with said primary heat exchanger;

each of said secondary heat exchangers being connected selectively with said high-pressure gas pipe and said low-pressure gas pipe through a selecting valve;

said liquid pipe being attached to a heating/cooling apparatus connected with a refrigerant flow-controlling valve.

* * * * *